US006012191A

United States Patent [19]

Caldwell

[11] Patent Number: 6,012,191

[45] Date of Patent: Jan. 11, 2000

[54] SUSPENSION BRIDGE HAVING A CENTRAL OBSERVATION POD AND HIGH RISE MULTI-USE COMMERCIAL BUILDINGS SANDWICHED BETWEEN THE BRIDGE SUPPORT PYLONS

[76] Inventor: H.L. Jack Caldwell, 2711 Ocean Blvd., Corona Del Mar, Calif. 92625

[21] Appl. No.: 09/102,802

[22] Filed: Jun. 23, 1998

Related U.S. Application Data

[60] Provisional application No. 60/051,298, Jun. 30, 1997.

[51] Int. Cl.[7] ..... E01D 11/02

[52] U.S. Cl. ..... 14/18; 14/20

[58] Field of Search ..... 14/18, 19, 20, 14/77.1, 78

[56] References Cited

U.S. PATENT DOCUMENTS

| | | | |
|---|---|---|---|
| 509,781 | 11/1893 | Weiss | 14/19 |
| 3,808,624 | 5/1974 | Barkdull, Jr. | 14/20 X |
| 3,859,682 | 1/1975 | Sulkiewicz | 14/18 X |

FOREIGN PATENT DOCUMENTS

| | | | |
|---|---|---|---|
| 591332 | 4/1959 | Italy | 14/18 |
| 1353864 | 11/1987 | U.S.S.R. | 14/18 |

OTHER PUBLICATIONS

"Tower Bridge", Tower Bridge and Tower Bridge Exhibition World–Wide Web Page. Internet address: www.southwark.gov.uk/tourism/attractions/tower _bridge/index.htm. (Date unknown).

"Welcome to Tower Bridge", Tower Bridge HomePage World–Wide Web Page. Internet address: http://www.towerbridge.org.uk/home.html. (Date unknown).

"Tower Bridge", The Thames Path: Tower Bridge World–Wide Web Page. Internet address: http://www.nationaltrails.gov.uk/thames/tp_facts/tower.htm (Date unknown).

Tower Bridge photograph, exterior overview. Great Buildings Online website. Internet address: http://www.greatbuildings.com/cgi–bin/gb . . . r Bridge.html/PCD.8203.3241.1525.078.gbi (Date unknown).

Tower Bridge photograph, view on the bridge, looking up. Great Buildings Online website. Internet address: http://www.greatbuildings.com/cgi.–bin/gb . . . r Bridge.html/PCD.8203.3241.1525.076.gbi (Date unknown).

"Tower Bridge," ChoiceWay Media & Travel Guides website. Internet address: http://www/choiceway.com/twr-big.htm (Date unknown).

"Structural Engineering Slide Library, Set C: Historic bridges: three–hinged", nisee website, National Information Service for Earthquake Engineering, University of California, Berkeley. Internet address: http://www.eerc.berkeley/edu/cgi–bin/browse_godd.

"Ponte Vecchio", Ponte Vecchio Website. Internet address: http://www.florence.ala.it/ing/foto/htm/pt _vecc.htm (Date unknown).

Page, Edith B., "Breaking Old Molds and Seeking New Patterns: Financing and Managing Major Projects in the U.S." For the Annual Conference of the Major Projects Association National Approaches to Transport Integration, Templeton College, Oxford, Sep. 1996.

Ponte Vecchio, Great Buildings Online Website. Internet address: http:www.greatbuildings.com/cgi–bin/gb . . . e Vecchio.html/PCD.8203.3241.1522.27.gbi.

Brooklyn Bridge, Virtual Tour: Brooklyn Bridge Website. Internet address: http://articles.citysearch.com/New York/virtualtour/brooklynbridge/index.html (Date unknown).

Picture, LaDefense Pedestrian Bridge, Paris. Internet address unknown. Date unknown.

*Primary Examiner*—James A. Lisehora
*Attorney, Agent, or Firm*—Knobbe, Martens, Olson & Bear, LLP

[57] ABSTRACT

A suspension bridge housing high rise buildings located at opposite ends of the bridge and integrally sandwiched within the supporting pylons of the bridge. The suspension bridge supports an observation pod at its center and a continuous series of tetrahedron members forming a lattice structure within which is located a hexagonal tube. A pedestrian transportation system is included within the hexagonal tube.

9 Claims, 8 Drawing Sheets

SUSPENSION BRIDGE HAVING A CENTRAL OBSERVATION POD AND HIGH RISE MULTI-USE COMMERCIAL BUILDINGS SANDWICHED BETWEEN THE BRIDGE SUPPORT PYLONS

RELATED APPLICATION

Pursuant to 35 U.S.C. § 119(e), this application claims the priority benefit of Provisional Application No. 60/051,298 filed Jun. 30, 1997.

FIELD OF THE INVENTION

This invention relates to a novel suspension bridge structure in combination with high-rise multi-user commercial buildings positioned between the bridge support pylons.

SUMMARY OF THE INVENTION

The present invention relates to a suspension bridge providing a spectacular solution to bridging two geographical locations in combination with two high rise multi-use commercial building structures integrally combined with the support pylons of the bridge. As a result, the real estate on which the pylons are situated has a dual utility. Thus, this real estate normally provides little, if any, economic return whereas suspension bridges constructed in accordance with my invention provide a substantial additional source of revenue to partially or entirely pay for the construction of the suspension bridge.

Another feature of my invention is that a passenger transportation system is contained within a hexagonal tube extending the length of the suspension bridge. This tube is supported by a continuous series of tetrahedron members that form a tetrahedron lattice structure extending the length of the suspension bridge.

An additional feature of my invention is an observation pod advantageously located at the center of the bridge span.

DETAILED DESCRIPTION OF THE PREFERRED EMBODIMENT

Figure 1:
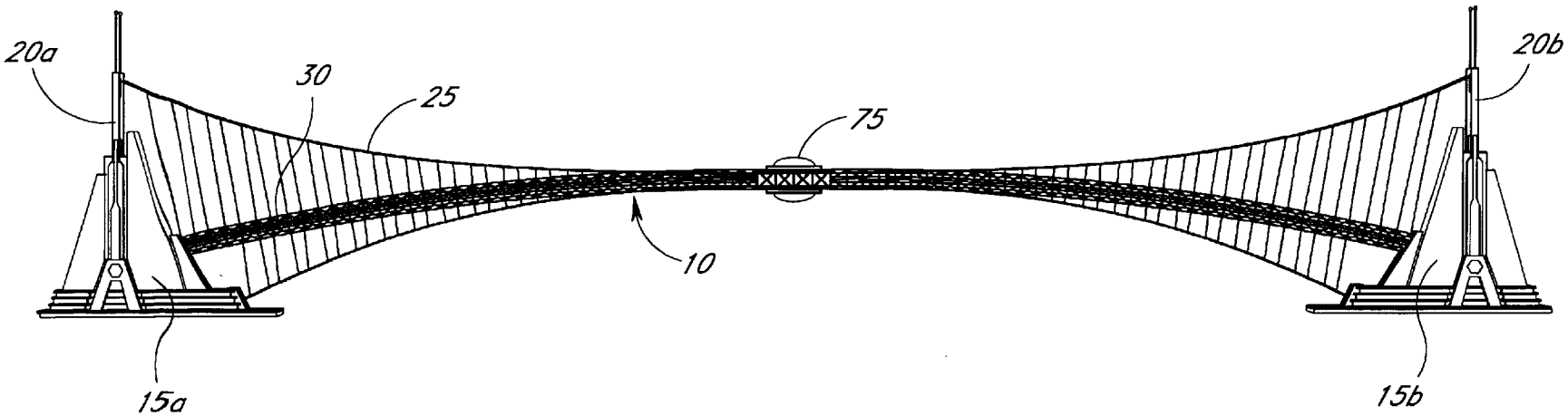
FIG. 1 is a side view of a suspension bridge constructed in accordance with my invention.
Figure 2:
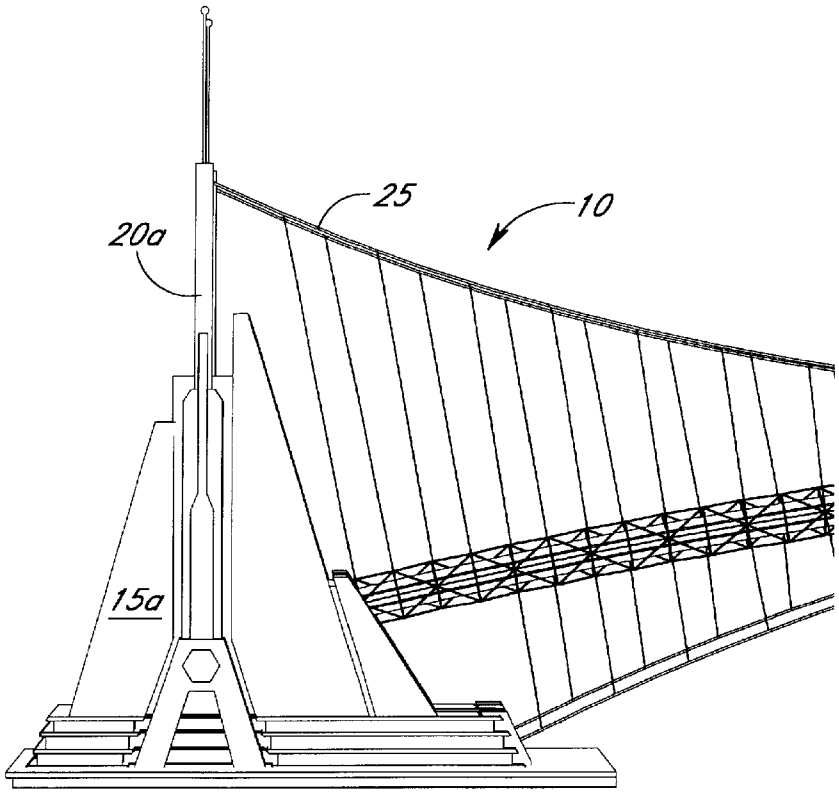
FIG. 2 is a perspective view of one end of the suspension bridge and the high rise building nested between the bridge pylons.
Figure 3:
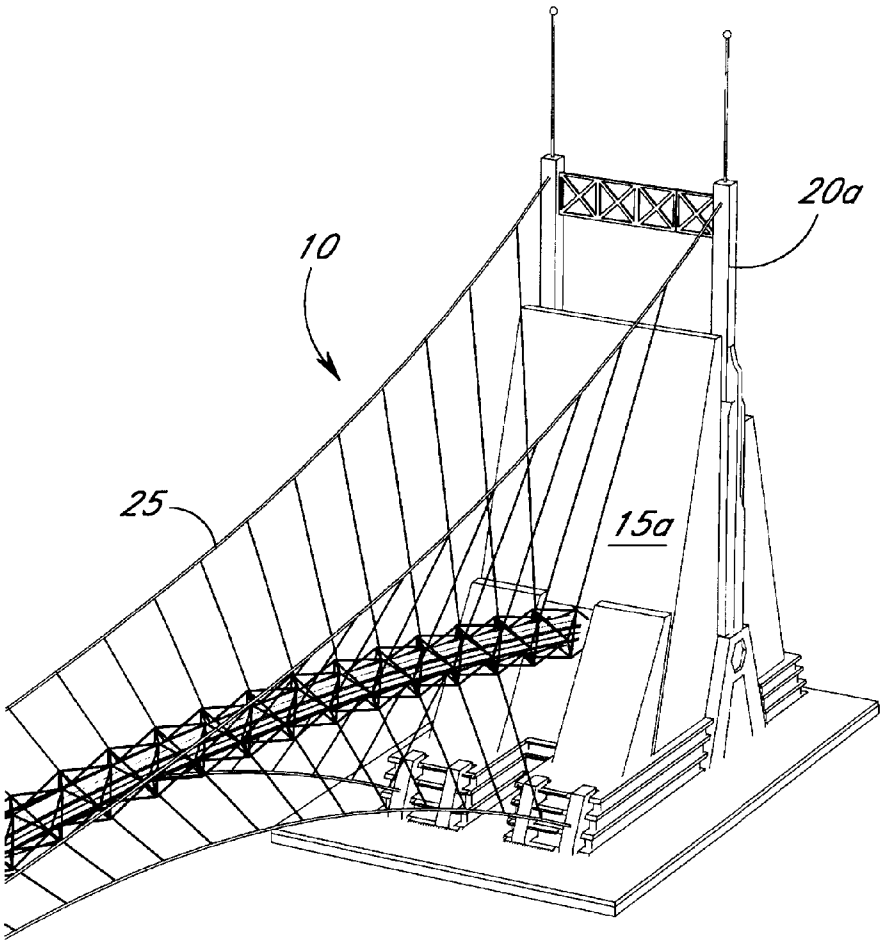
FIG. 3 is a perspective view of the opposite end of the suspension bridge constructed in accordance with my invention showing a second high rise building nested between the bridge pylons.

In the following description, by way of specific example, my invention is described as if constructed to span Victoria Harbour, Hong Kong, China, with pylons and associated nested high rise office buildings being located in the geographical areas of Kowloon and Hong Kong Island. This bridge would provide pedestrian travel and view observation from one side of Victoria Harbour to the other, that is between the two geographical areas of Kowloon and Hong Kong Island. Heretofore, these two commercial areas, separated by a major waterway, have developed somewhat different economic and business commerce associated with these locations. This invention will enable easy physical exchange between the two areas and enable a new synergistic relationship to be created. My invention, however, is not limited to this specific location and can be employed in any suitable location worldwide.

Referring to FIGS. 1, 2, 3 and 4 is shown a suspension bridge 10 constructed in accordance with my invention designed to span Victoria Harbour. One high rise building 15*a* is illustrated on the left and another high rise building 15*b* is shown on the right. These buildings are advantageously multi-user buildings holding offices, apartments and the like. The height of the bridge at the center location is approximately 350 feet. The clear span between the supporting pylons 20*a*, 20*b* is approximately 4000 feet. The respective office buildings 15*a*, 15*b* are sandwiched between pylons 20 spaced 250 feet apart at each end of the bridge. The lower level of the two buildings 15*a*, 15*b* advantageously contain shopping malls.

The cable suspension system 25 supports moving and stationary pedestrian walkways and a five story pod 75 which advantageously contains museum, shopping, resting and observations areas. The construction materials, for my invention are well known in the art and include a combination of steel, composites, reflective glass, plastics and reinforced concrete.

This bridge would provide pedestrian travel and view observation from one side of Victoria Harbour to the other, that is between the two geographical areas of Kowloon and Hong Kong Island.

Figure 5:
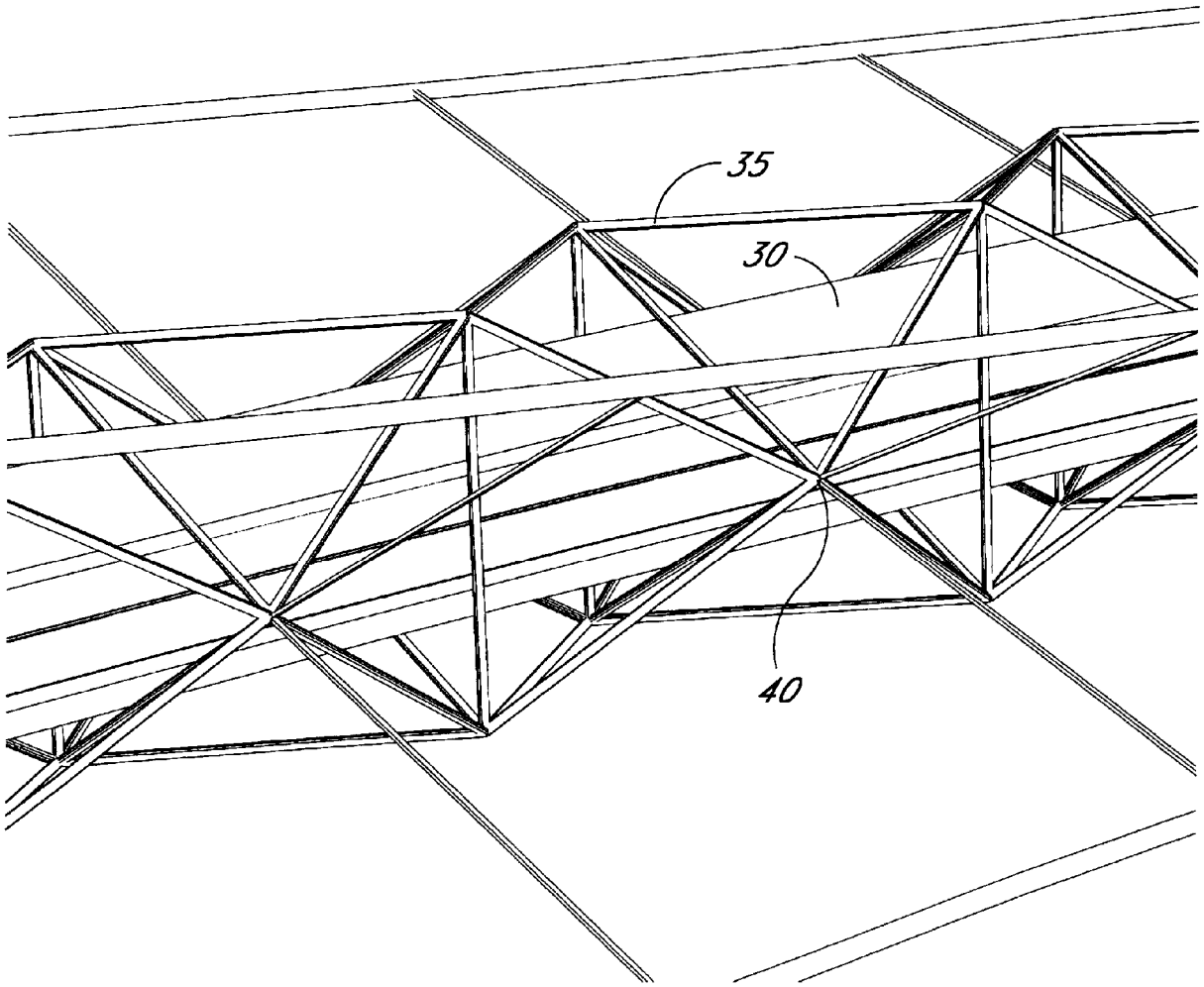
FIG. 5 illustrates the details of the tetrahedron members supporting the hexagonal pedestrian and mechanical systems tube.

The buildings 15*a* and 15*b* are approximately 250 feet in width and are placed between the structural pylons 20 (FIGS. 2 and 5) that support the suspension cable system 25. The four pylons 20 (two for each side) will reach to a height of 1000 feet. The respective buildings 15*a*, 15*b* are sandwiched or nested between their respective pylons 20. These buildings will typically reach a height in excess of 625 feet. The suspension cables 25 support and stabilize the pedestrian system.

Figure 4:
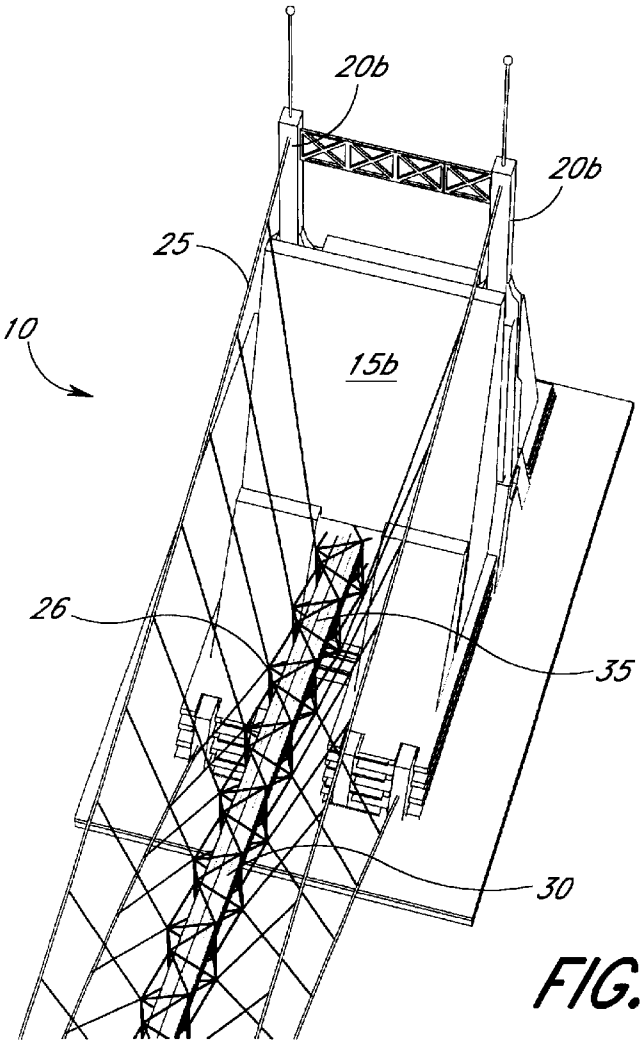
FIG. 4 is a bird's eye perspective view of one end of the bridge.

Referring to FIGS. 4, 5, 6, 7, and 8, the pedestrian transportation system comprises a 40-foot diameter hexagonal structure 30 encompassed within a lattice or labyrinth of supporting members which are arranged as a continuous series of tetrahedron members 35 with attachment connectors 40 at the apex of each triangle. As best shown in FIG. 4, at the exterior points of the continuous tetrahedrons there are attachment members 26 serving as connections to the supporting suspension cables 25. Because of the hexagonal nature of the tube, it fits inside of the tetrahedron lattice. As best shown in FIGS. 1 and 4, the ends of the tube terminate at the respective high rise buildings 15*a*, 15*b*.

Figure 6:
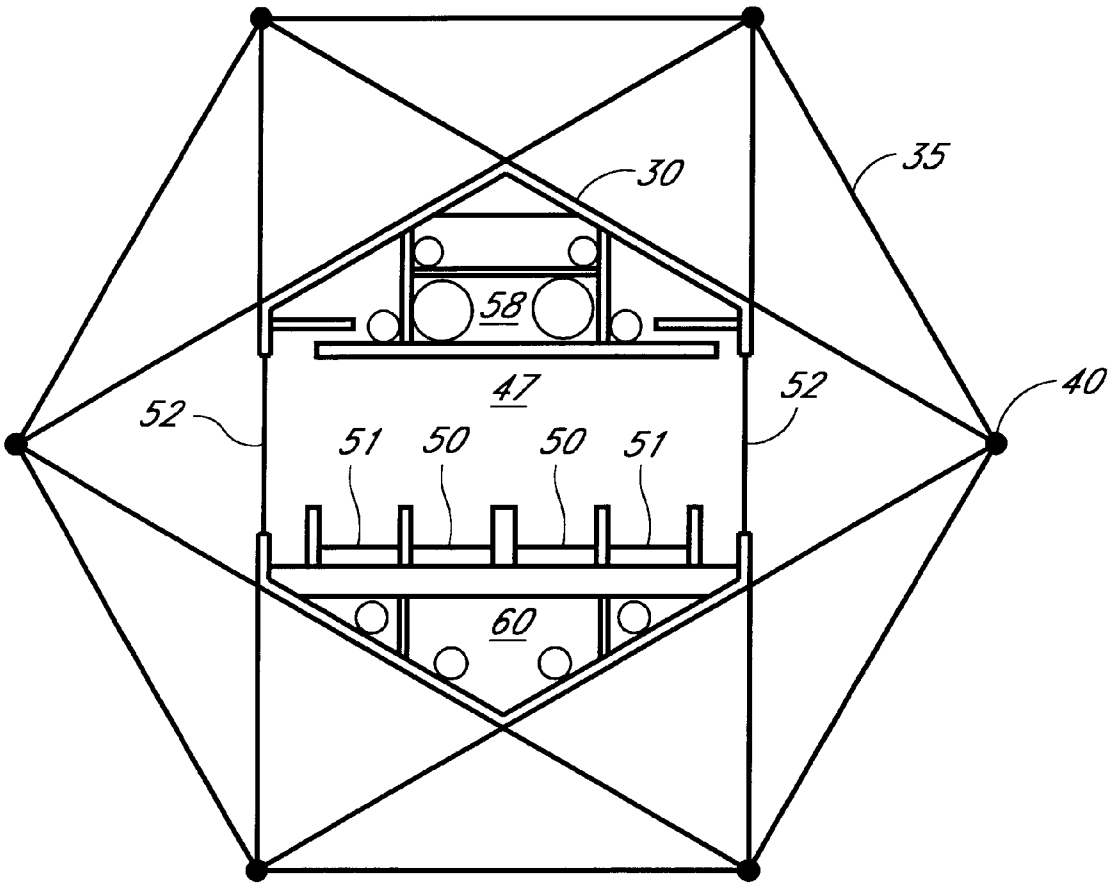
FIG. 6 is a cross-sectional view of the hexagonal tube enclosing the transportation and mechanical systems.

As shown in FIG. 6, the interior of the hexagonal pedestrian tube 30 is divided into three major floors. The central floor 47 of the pedestrian tube 30 contains two moving sidewalk systems 50 traveling in opposite directions for providing a pedestrian transportation system. Outboard of the moving sidewalks 50 are located two stationary walkways 51 and related observation areas. On each side of the moving sidewalks are walking areas and observation alcoves. By providing panels 52 of interior "see through" mirror glass along the two vertical sides of the passageway, the pedestrians are afforded unobstructed views.

The upper floor 58 of the pedestrian tube 30 supports the mechanical systems; the electrical, air conditioning, water and communications. The lower floor 60 of the pedestrian tube 30 contains service facilities and waste disposal lines.

Figure 7:
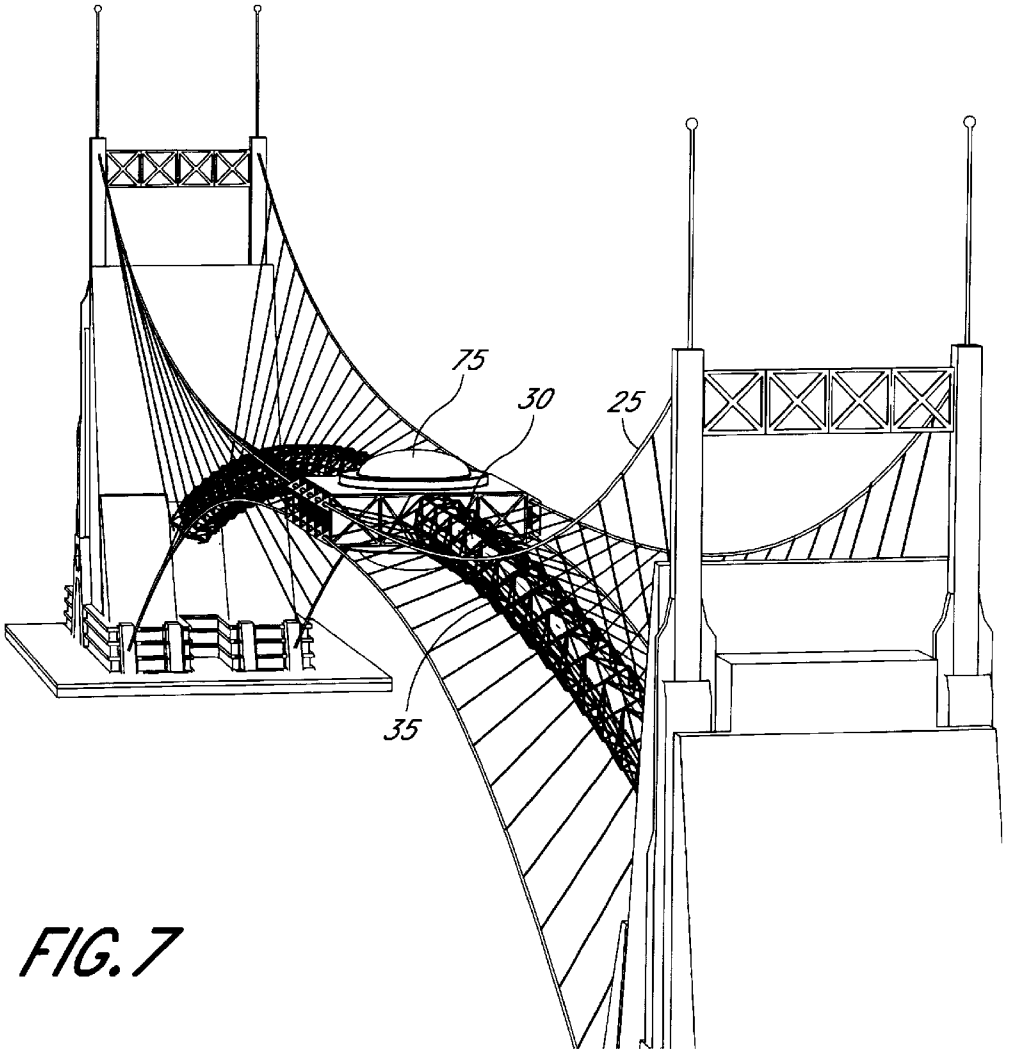
FIG. 7 is a perspective view of the observation pod located at the center of the bridge span.
Figure 8:
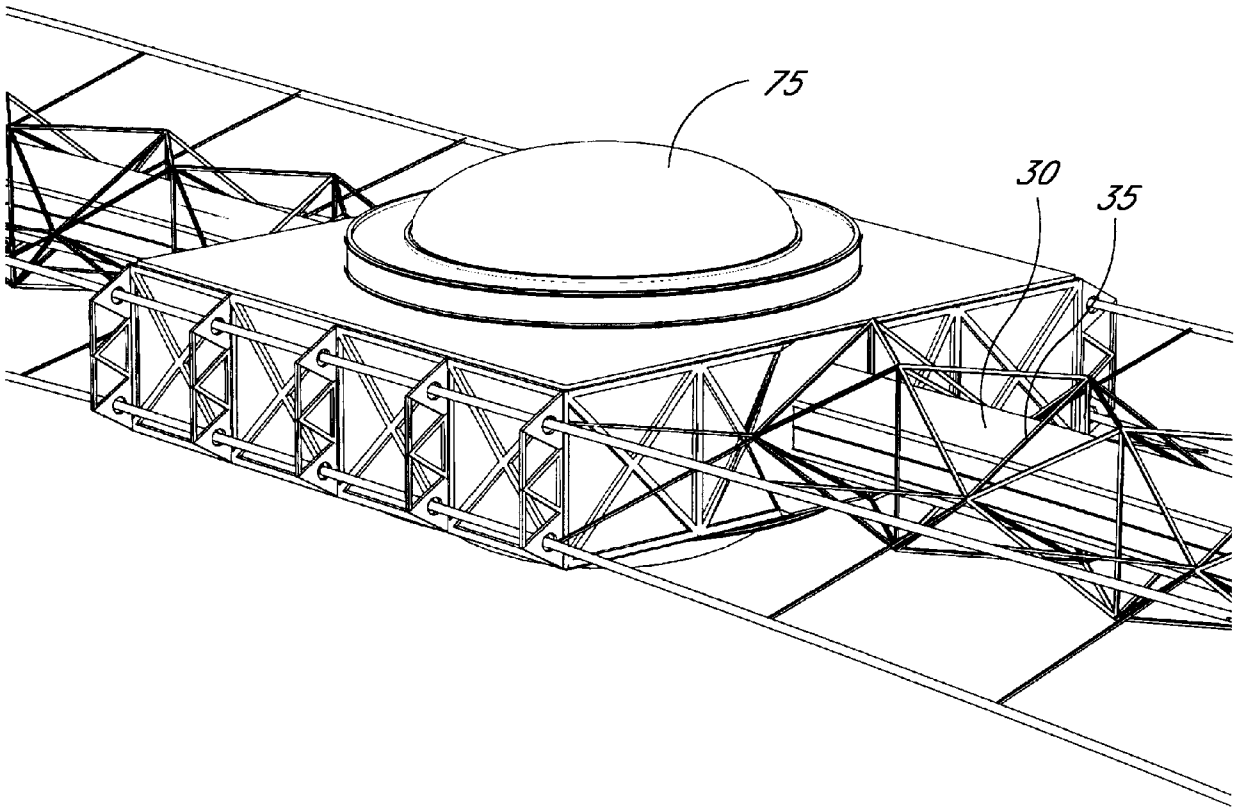
FIG. 8 is another perspective view of the observation pod.

Referring now to FIGS. 7 and 8, at the center of the bridge span is located a five story observation pod 75 connected to tube 30 and the pedestrian transportation system within tube 30. Pod 75 accommodates many uses, including a museum, restaurant, viewing and casual relaxation viewing areas, governmental observation posts and shopping facilities. The width of the pod structure is advantageously the same width, 250 feet, as the distance between pylons 20 located at opposite ends of the bridge span.

In addition to providing a suspension bridge affording a spectacular means for bridging two remote areas, my invention provides a method for improving the manner in which such a bridge is financed. As noted above, the real estate occupied by conventional suspension bridges does not generate income whereas in my invention, the high rise building 15*a*, 15*b* and pedestrian transportation system both provide rental income revenue for paying for construction of the suspension bridge.

Although the preferred embodiment of the present invention has been described and illustrated above, those skilled in the art will appreciate that various changes and modifications can be made to the present invention without departing from its spirit. Accordingly, the scope of the present invention is defined only by the following appended claims.

What is claimed is:

1. A suspension bridge including:

suspension cables, pylons at each end of said bridge for supporting opposite ends of said suspension cables;

a lattice web of support members arranged as a substantially continuous series of tetrahedrons along the span of said bridge, said tetrahedrons having exterior points;

attachment members at said exterior points of said tetrahedrons attaching said tetrahedrons to said suspension cables;

a substantially hexagonal tube located within and attached to said lattice web, said tube extending substantially from one end to the other end of said bridge; and a pedestrian transportation system contained within said substantially hexagonal tube.

2. The suspension bridge of claim 1, wherein said hexagonal tube includes a centrally located floor and moving sidewalks traveling in opposite directions located on said floor.

3. The suspension bridge of claim 2, wherein said hexagonal tube includes an upper level above said centrally located floor, and mechanical equipment including electrical, air conditioning, water and communications located within said upper level.

4. The suspension bridge of claim 2, wherein said hexagonal tube includes a lower level below said centrally located floor, and service facilities and waste disposal lines located within said lower level.

5. The suspension bride of claim 1, including an observation pod located substantially at the center of said bridge, said pod accessible to said pedestrian transportation system.

6. The suspension bridge of claim 5, wherein said pod is substantially the width supporting a pair of said pylons located at one end of said bridge.

7. The suspension bridge of claim 1, wherein a portion of the side of said hexagonal tube includes "see through" mirror glass.

8. The suspension bridge of claim 1 having a high rise building structure sandwiched between the pylons at one end of said bridge with one end of said pedestrian transportation system beginning at said high rise building.

9. The suspension bridge of claim 8 having a second high rise building structure sandwiched between the pylons at the opposite end of said bridge, the opposite end of said pedestrian transportation system terminating at said second high rise building.

* * * * *